US005133520A

United States Patent [19]

Daly

[11] Patent Number: 5,133,520

[45] Date of Patent: Jul. 28, 1992

[54] MISSILE GUIDANCE SYSTEMS

[75] Inventor: Martin A. K. Daly, Harpenden, England

[73] Assignee: British Aerospace Public Limited Company, London, England

[21] Appl. No.: 89,119

[22] Filed: Nov. 12, 1970

[30] Foreign Application Priority Data

Nov. 13, 1969 [GB] United Kingdom ..... 55729/69

[51] Int. Cl.[5] ..... F41G 7/32

[52] U.S. Cl. ..... 244/3.12

[58] Field of Search ..... 244/3.12, 313

[56] References Cited

U.S. PATENT DOCUMENTS 2,944,763 7/1960 Grandgent et al. ..... 244/3.14

3,098,933 7/1963 Barash ..... 244/3.14 X

*Primary Examiner*—Charles T. Jordan

*Attorney, Agent, or Firm*—Cushman, Darby & Cushman

[57] ABSTRACT

A sighting and tracking apparatus for a missile guidance system, of the kind which employs an optical tracker for tracking and controlling the flight of a missile, the tracker providing output signals which are transmitted to the missile to control the missile to a demanded flight path. The apparatus includes an adjustable electrical model of the flight path demanded by the tracker, and a computer to which the tracker output signals are continuously fed, the computer being programmed to adjust the model continuously during missile flight in such a way as to cause the model to conform to the demanded flight path at each instant of flight. The model produces continuous control signals dependent on its adjustment, and in the event that control of the missile by the tracker is lost during flight, adjustment of the model by the computer is immediately stopped and the control signals from the model in its existing state of adjustment are employed to direct the continued flight of the missile.

5 Claims, 3 Drawing Sheets

MISSILE GUIDANCE SYSTEMS

This invention relates to missile guidance systems and is concerned with sighting and tracking apparatus for such systems.

The invention is particularly, although not exclusively, applicable to a guidance system of the kind described and claimed in our co-pending application Ser. No. 89,139, filed Dec. 11, 1970, which comprises an optical sight for aiming at a target, a manually-operable control to generate primary control signals in response to manipulation thereof by an operator, means for transmitting the primary control signals to a receiver in the missile to guide the missile in flight in accordance with the operator's manipulation of the manually-operable control, an optical tracker approximately aligned with the sight for tracking a missile in flight in the field of view of the tracker, the tracker being constructed and arranged to measure the displacement of the missile from the tracker axis and to generate secondary control signals representative of the said displacement, and means for transmitting the secondary control signals to a receiver in the missile for guiding the missile to reduce such displacement, whereby the missile is controlled by the combined primary and secondary signals.

One object of the present invention is to enable a guidance system of this kind to operate when the functioning of the tracker is interrupted either intermittently or permanently.

According to the present invention, a guidance system for a missile comprises an optical sight for aiming at a target, and an optical tracker approximately aligned with the sight for tracking the missile in flight in the field of view of the tracker, the tracker being constructed and arranged to measure the displacement of the missile from the tracker axis and to generate control signals representative of the said displacement, and means for transmitting the control signals to a receiver in the missile for guiding the missile to reduce such displacement, and includes an analogue model of the demanded flight path of the missile as controlled by the tracker output, means for adjusting the model continuously during the flight to cause it to conform to the flight path demanded by the tracker output, and means for deriving continued control signals from the model to direct the continued flight of the missile along the modelled flight path in the event of control by the tracker becoming unavailable during the flight.

In one form of the invention the system also includes a manually-operable control for use in combination with the tracker control, the manually-operable control generating primary control signals in response to manipulation thereof by an operator, and means being provided for transmitting the primary control signals to a receiver in the missile to guide the missile in flight in accordance with the operator's manipulation of the manually-operable control, whereby the missile is controlled in flight by the combination of the primary signals and the signals (referred to as the secondary control signals) from the tracker or model.

The system may include a computer constructed and arranged to receive output signals from the tracker and to continuously adjust the model throughout the flight in such a way that the modelled flight path is maintained similar to the flight path demanded at each instant by the tracker output.

There may also be included in the system a detector operating in response to loss by the tracker of the optical signal from the missile to which the tracker responds, the detector when operated disconnecting the tracker output from the computer.

The invention may be carried into practice in various ways, but one specific embodiment will now be described by way of example only and with reference to the accompanying drawings, in which.

Figure 1:
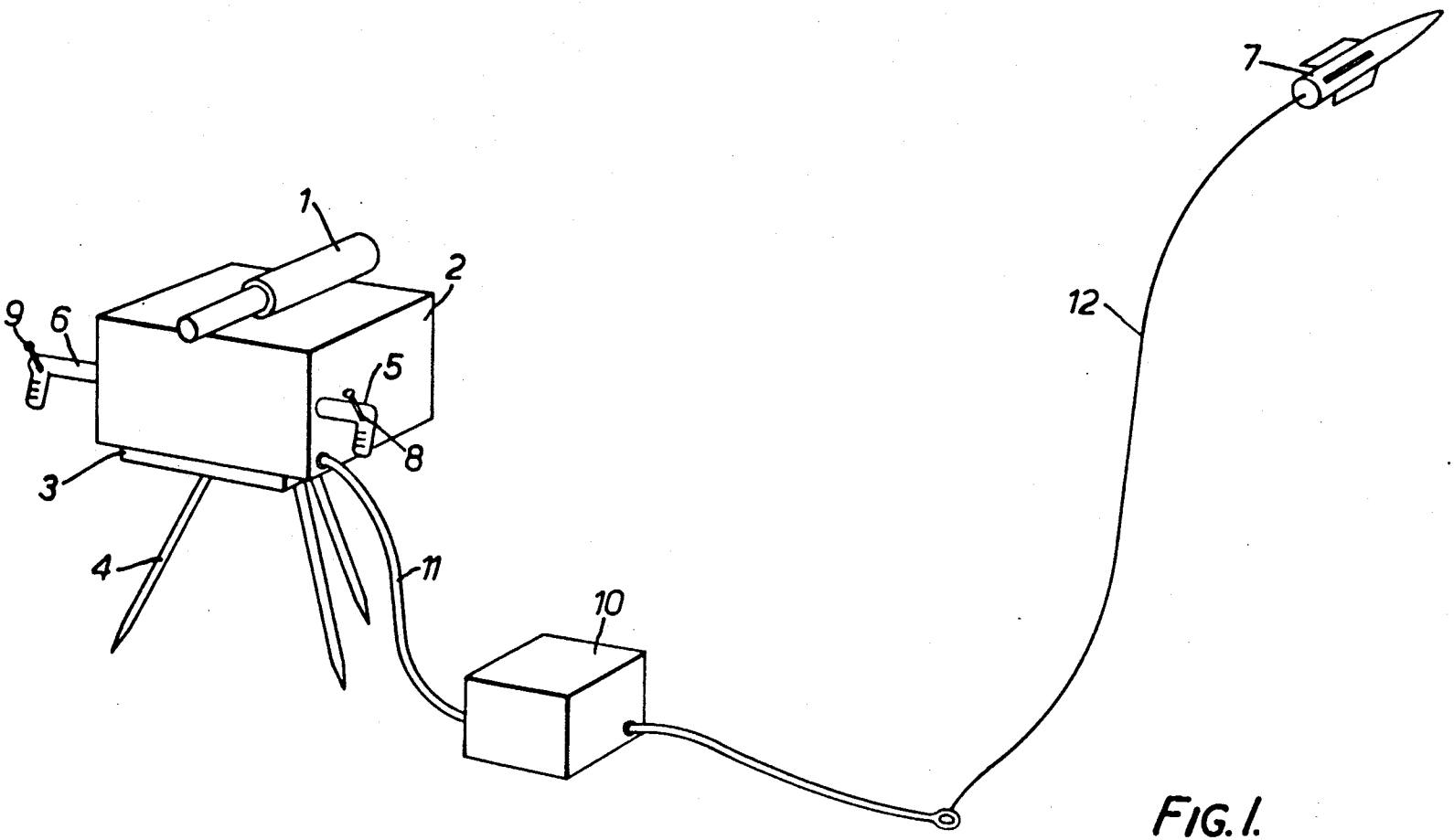
FIG. 1 is a diametric view of a guided missile control installation.

In the illustrated embodiment, with reference first to FIG. 1, the installation comprises a telescopic sight 1 and a tracker 2 which are secured together and rotatably supported on a pivotal mounting 3 upon a tripod 4. The telescopic sight 1 and tracker 2 have their optical axes generally aligned. A pair of handlebars, 5, 6 are carried by the housing of tracker 2. One handlebar 5 includes a joystick 8 for operation by an operator to supply flight control signals to a missile 7. A firing button 9 is provided in the other handlebar 6 in order that the operator may fire a missile at the appropriate time. A separate controller in a housing 10 placed alongside the tripod 4 is electrically connected to the joystick control 8 and the tracker 2 by means of a cable 11. The joystick 8 is able to generate primary directional control signals for transmission to the missile 7 for controlling the flight of the missile, and these primary signals from joystick 8 are applied via cable 11 to an electrical shaping unit 13 (FIG. 2) in the controller housing 10, which unit suitably modifies the signals and supplies them to a transmitter 14 also positioned within the housing 10, for transmission via a trailing cable 12 to a receiver mounted in the missile 7. The primary signals received by the receiver are employed to control the operation of the actuators of the appropriate control surfaces of the missile 7. The tracker 2 is of the known kind having a photoelectric screen on which a real optical image of a flare carried by the missile is focussed, the tracker producing secondary control signals corresponding to the coordinates of the displacement of the missile image on the photoelectric screen from the electrical centre of the screen. A second shaping unit 15 within the housing 10 receives the secondary electrical output signals via the cable 11 from the tracker 2, which signals are therefore representative of the direction and extent to which the missile is offset from the tracker axis. The second shaping unit suitably modifies the secondary signals and supplies them to the transmitter 14 in the housing 10 for transmission via the cable 12 to the receiver in the missile for controlling the flight of the missile.

Figure 2:
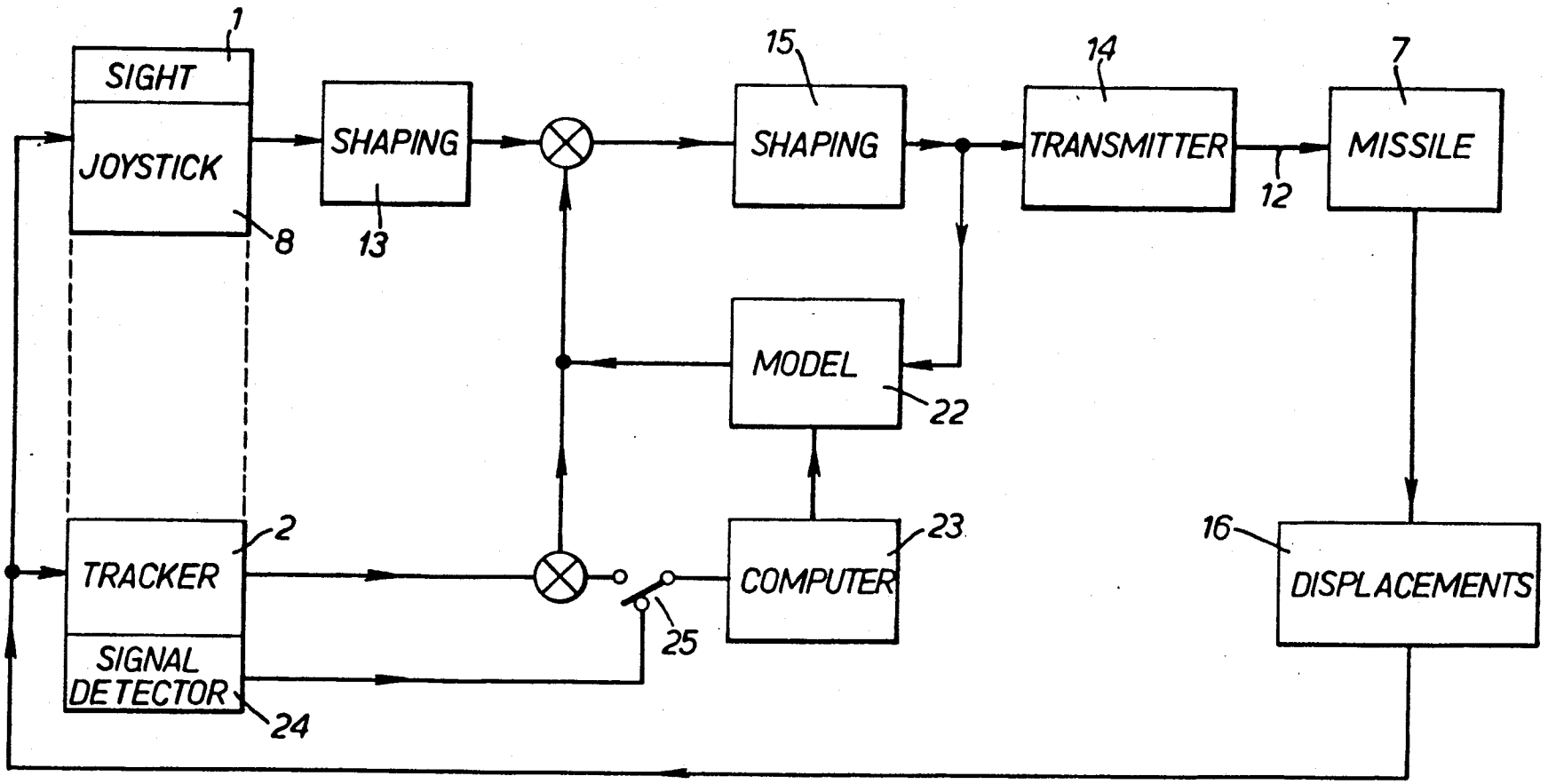
FIG. 2 is a block diagram of the combined manual and semi-automatic control system incorporated in the installation.

Referring now to FIG. 2, this shows diagrammatically the circuit of the control system incorporated in the apparatus of FIG. 1, comprising a manual loop and a semi-automatic loop.

The manual control loop includes the joystick 8 arranged to generate the primary control signals by means of a human operator who views a target through a sight 1. The electrical output signals from the joystick 8 are applied to the shaping unit 13 in which they are suitably modified before being passed to the missile 7 via the transmitter 14 and the trailing wire command link 12.

Displacements 16 of the missile from the required course, due to target motion etc., are observed by the operator who can, if necessary, move the joystick 8 to cause appropriate direction correcting signals to be supplied to the missile.

The semi-automatic loop includes the optical tracker 2 generally aligned with the sight 1. The electrical output produced by the tracker, representative of the extent and direction of the displacement of the missile from the tracker axis, is fed to the shaping unit 15 and then to the missile 7 via the transmitter 14 and the trailing wire command link 12. Transient displacements 16 of the missile from the aimed path along the tracker axis to the target are thereby detected by the tracker and automatically corrected by the appropriate output control signal.

In use, the operator aims his sight 1 at a target and launches a missile 7 which is gathered by the tracker 2. The course of the missile along the tracker axis is then controlled automatically by the tracker, the operator utilizing the joystick 8 to maintain the direction of the flight path on his sight line to the target.

Figure 3:
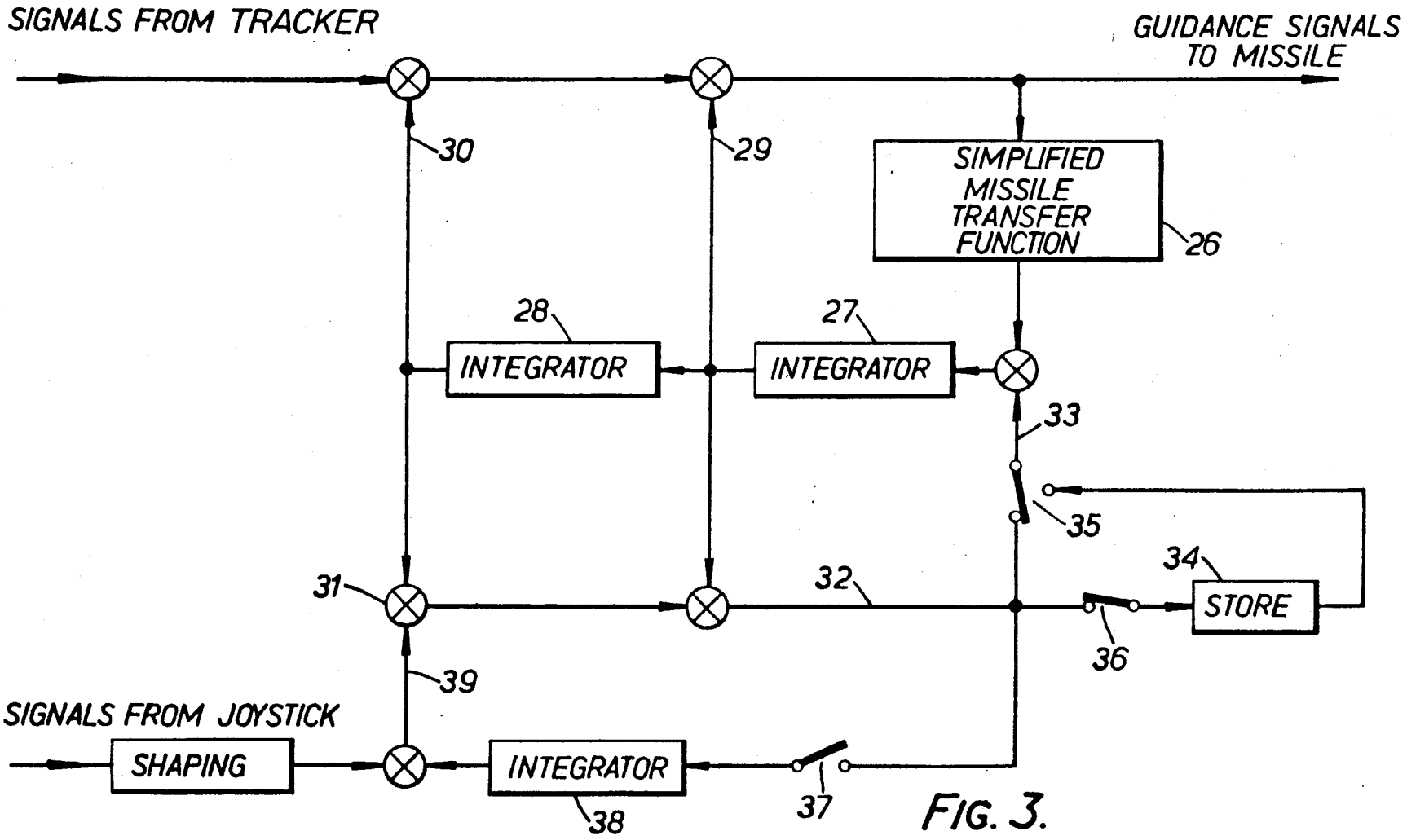
FIG. 3 is a diagram showing one practical arrangement of the control system.

There may be times however when the tracker 2 loses the signal from the missile, and such loss may be temporary or may last for the remainder of the flight. In order to overcome such occurrences, from the moment of launch of a missile the output from the shaping unit 15 is also fed to an electrical circuit model 22 which may be comprised of circuit members 26, 27 and 28 shown in FIG. 3 representing the actual flight path of the missile. The output from the tracker 2 is also fed to a computer 23 which continuously adjusts the model 22 so that its output in terms of missile position is the same as that actually measured by the tracker 2.

In use of the proposed arrangement, the operator aims his sight 1 at a target and launches a missile 7 which is gathered by the tracker 2. The course of the missile 7 towards the target is controlled by the tracker 2, and is manually adjusted onto the target by means of the joystick 8. Should the tracker 2 suddenly cease to produce an output, as would occur if the missile flew into a patch of smoke, a presence-of-signal detector 24 will respond to the loss of signal and cause a switch 25 to open, thereby disconnecting the tracker 2 from the computer 23. Control signals to the missile will then be derived from the model 22 in the condition to which it was previously adjusted by the computer, and from the output of the joystick 8.

The response of the missile to movements of the joystick 8 is unaffected by disconnection of the tracker 2, and the effect upon the control by the operator will only be that he will now have to counteract any transient displacements 16 of the missile which previously would have been removed by the tracker 2.

Should the signal from the missile reappear and be received again by the tracker 2, the switch 25 will be closed automatically by means of the presence-of-signal detector 24, and guidance of the missile by means of the combined joystick output and tracker output will be resumed.

One simple method of realizing the functions of the model 22, computer 23 and shaping 15 illustrated in FIG. 3. Here the electronic model 22 consists in the simplified missile transfer function 26 and the two integrators 27 and 28. The shaping 15 is accomplished by feed-back along path 29. The output of the model is both fed into the missile guidance channel along path 30 and differenced with the tracker measurements at 31. Any difference between the tracker measurements and the model output is fed back via paths 32 and 33 so as to maintain the two outputs equal. In do doing, the first, second and third order biases are stored in the integrators 28 and 27 and the store 34, thus matching the model to the actual system.

If the missile tracking is interrupted, switch 35 is automatically changed over, switch 36 opened, and switch 37 closed, all by the signal detector 24 and switch 25. Guidance is then continued using the matched model in place of the tracker. In this mode, the loop containing switch 37 and integrator 38 is also brought into operation. This loop ensures that the error signal 39 derived from the tracker is made identical with that from the model, any difference being backed off by the integrator 38. Should the signal re-appear in the tracker, switches 35, 36 and 37 are returned to the positions shown in FIG. 3 and any difference between the model and the tracker measurement at the time of switching is stored in integrator 38 and fed continuously into the system. The output from integrator 38 thus ensures that no transient disturbance is fed into the system when the tracker is switched back into the loop.

What I claim as my invention and desire to secure by Letters Patent is:

1. A guidance system for a missile, which comprises an optical sight for aiming at a target, an optical tracker approximately aligned with the sight for tracking the missile in flight in the field of view of the tracker, the tracker including means for measuring the displacement of the missile from the tracker axis and generating control signals representative of the said displacement, and means for transmitting the control signals to a receiver in the missile for guiding the missile to reduce such displacement, means for producing a further electrical signal representing an analogue model of the demanded flight path of the missile as controlled by the tracker output, means for adjusting the signal representing said model continuously during the flight to cause it to conform to the flight path demanded by the tracker output, and means for deriving continued control signals representing the model to direct the continued flight of the missile along the modelled flight path in the event of control by the tracker becoming unavailable during the flight.

2. A guidance system as claimed in claim 1 which also includes a manually-operable control for generating primary control signals in response to manipulation thereof by an operator, and means for transmitting the primary control signals to a receiver in the missile to guide the missile in flight in accordance with the operator's manipulation of the manually-operable control, whereby the missile is controlled in flight by the combination of the primary control signals and the signals (referred to as secondary control signals) from the tracker or model.

3. A guidance system as claimed in claim 2 in which the means for adjusting the model comprises a computer constructed and arranged to receive output signals from the tracker and to continuously adjust the model in such a way that the modelled flight path is maintained similar to the flight path demanded at each instant by the tracker output.

4. A guidance system as claimed in claim 3 in which the tracker operates in response to an optical signal from the missile and which includes a detector operative in response to the loss of that optical signal by the tracker to disconnect the tracker output from the computer.

5. A guidance system as claimed in claim 4 in which the model is connected in a feed-back servo loop from the control signal output to the missile.

* * * * *